US007748392B2

(12) United States Patent
Balthazor et al.

(10) Patent No.: US 7,748,392 B2
(45) Date of Patent: Jul. 6, 2010

(54) EDGE CLEANER DEVICE FOR COATING PROCESS

(75) Inventors: Steven Lee Balthazor, Black Creek, WI (US); George Karl Peters, Appleton, WI (US); Daniel Dean Rayer, Appleton, WI (US); Charles Milo Van Asten, Little Chute, WI (US); Nathan James Vosters, Little Chute, WI (US)

(73) Assignee: Appleton Papers Inc., Appelton, WI (US)

( * ) Notice: Subject to any disclaimer, the term of this patent is extended or adjusted under 35 U.S.C. 154(b) by 1514 days.

(21) Appl. No.: 10/778,097

(22) Filed: Feb. 17, 2004

(65) Prior Publication Data

US 2005/0178404 A1 Aug. 18, 2005

(51) Int. Cl.
*B08B 3/00* (2006.01)

(52) U.S. Cl. ..... 134/104.2

(58) Field of Classification Search ..... 15/265.5, 15/302, 309.1; 134/104.2, 129, 131
See application file for complete search history.

(56) References Cited

U.S. PATENT DOCUMENTS

| | | | | |
|---|---|---|---|---|
| 2,653,566 | A | | 9/1953 | Worden |
| 3,351,039 | A | | 11/1967 | Heisterkamp |
| 4,359,964 | A | | 11/1982 | Johnson |
| 4,641,070 | A | * | 2/1987 | Pfizenmaier et al. ..... 318/640 |
| 4,924,891 | A | | 5/1990 | Soubrier et al. |
| 5,328,511 | A | * | 7/1994 | Beisswanger ..... 118/203 |
| 5,688,555 | A | | 11/1997 | Teng |
| 5,718,763 | A | | 2/1998 | Tateyama et al. |
| 5,780,109 | A | | 7/1998 | Yapel et al. |
| 5,783,044 | A | * | 7/1998 | Schneider et al. ..... 162/278 |
| 5,858,090 | A | * | 1/1999 | Gottwald ..... 118/119 |
| 5,939,139 | A | | 8/1999 | Fujimoto |
| 6,145,217 | A | * | 11/2000 | Goebel ..... 34/117 |
| 6,176,245 | B1 | | 1/2001 | Takahashi et al. |
| 6,176,939 | B1 | | 1/2001 | Oechsle et al. |
| 6,364,959 | B1 | | 4/2002 | Straub et al. |
| 2003/0127107 | A1 | | 7/2003 | Cheng et al. |

FOREIGN PATENT DOCUMENTS

JP 06-115782 * 4/1994

* cited by examiner

*Primary Examiner*—Joseph L Perrin
(74) *Attorney, Agent, or Firm*—Birch, Stewart, Kolasch & Birch, LLP

(57) ABSTRACT

An edge cleaning device, a system for cleaning an outside edge of a movable, coated web, and a method of cleaning the outside edge of the movable, coated web include a unique combination of desirable features. An edge cleaner device is automatically positioned with respect to an outside edge of a movable, coated web, wherein the edge cleaner device is positioned upstream from a backing roller for operatively engaging an underside of the moving, coated web. A fluid jet from a nozzle assembly of the edge cleaner device is applied toward the underside and the outside edge of the moving, coated web. A scraper device can be operatively engaged with an upper surface of the moving web without contacting an upper surface of the backing roller and the collection device may be imparted with a vacuum to assist in the removal of excess coating collected by the edge cleaning device.

18 Claims, 6 Drawing Sheets

EDGE CLEANER DEVICE FOR COATING PROCESS

BACKGROUND ART

1. Field of the Invention

The present invention is generally directed toward an edge cleaning device for a coated web, and more particularly to a non-contact edge cleaning device for a moving web that has been coated and transported with the benefit of rollers.

2. Description of the Background Art

The following discussion of the background art is a result of the present inventors analysis of the systems and features of the related technology of the background art. The present inventors have determined that there are unique problems associated with coated webs and the available technology related to the cleaning of coated webs, particularly along the edges of coated webs moving through a coating or other similar process.

U.S. Pat. No. 3,351,039 to Heisterkamp, the entirety of which is hereby incorporated by reference, describes an exemplary roll cleaning device of the background art particularly designed to clean the edges of a sheet coating roll. Heisterkamp describes problems associated with the coating of certain sheet materials, such as sheets coated with latex materials. Often the coated sheet is applied with a coating in a quantity greater than the desired coating thickness to ensure full or adequate coverage over the sheet. The coated sheet is then carried over a backing roll where a proper coating weight is achieved by a knifing action of an air jet. The excess coating is subsequently sheared off to a collection pan below the air jet. The excess coating often carries over the edges of the sheet with the result that the backing roll is eventually coated with the excess coating material.

As seen in FIG. 1 of the present application, a coating is applied between a coating roll 22 pressed against a rubberized backing roll 20 in an exemplary coating process. However, another problem encountered in coating the web 10 is that some of the excess coating will try to wrap around the moving web from a first coated side 12 (underside of the web 10) to an opposite, typically uncoated side 14 both upstream of and at the backing roller 20. The present inventors have determined that there are variety of edge cleaning approaches that can be advantageously applied to overcome these problems associated with coated, moving webs moving through similar processes.

SUMMARY OF THE PRESENT INVENTION

The present invention overcomes the shortcomings associated with the background art and achieves other advantages not realized by the background art.

An aspect of the present invention, in part, is directed toward an edge cleaner device for a moving web that is capable of cleaning the edge of a moving web both at and before (upstream) of a backing or coating roller.

An aspect of the present invention, in part, is directed toward an edge cleaner device for a moving web that is capable of cleaning the edge of a moving web while minimizing undesirable carryover of excess coating to uncoated portions of the moving web.

An aspect of the present invention, in part, is directed toward an edge cleaner device for a moving web that is capable of cleaning the edge of a wide range of sizes of moving web(s) and automatically aligning and positioning the edge cleaner device with respect to the outside edge or width of the moving web.

One or more of the foregoing aspects of the present invention is accomplished, in part, by an edge cleaning device for an outside edge of a moving, coated web, the device comprising a nozzle assembly imparting a fluid jet toward the outside edge of the moving, coated web; and a scraper device operatively secured with the nozzle assembly to a common carriage, wherein the nozzle assembly and the scraper device are capable of being simultaneously positioned by the carriage along the outside edge of the moving, coated web.

One or more of the foregoing aspects of the present invention is also accomplished, in part, by an edge cleaning device for an outside edge of a moving, coated web, the device comprising a nozzle assembly imparting a fluid jet toward the outside edge of the moving, coated web; and a collection container operatively secured with the nozzle assembly to a common carriage, wherein the collection container and the nozzle assembly are capable of being simultaneously positioned by the carriage along the outside edge of the moving, coated web, and the fluid jet of the nozzle assembly is directed in a direction toward an opening of the collection container.

One or more of the foregoing aspects of the present invention is also accomplished, in part, by a system for cleaning an outside edge of a moving, coated web, the system comprising a moving, coated web; a roller for operatively engaging the moving, coated web; a movable carriage supporting an edge cleaning device; a nozzle assembly imparting a fluid jet toward the outside edge of the moving, coated web; and a scraper device operatively secured with the nozzle assembly to the movable carriage, wherein the nozzle assembly and the scraper device are capable of being simultaneously positioned by the carriage along the outside edge of the moving, coated web.

One or more of the foregoing aspects of the present invention is also accomplished, in part, by a system for cleaning an outside edge of a moving, coated web, the system comprising a moving, coated web; a roller for operatively engaging the moving, coated web; a movable carriage supporting an edge cleaning device; a nozzle assembly imparting a fluid jet toward an outside edge of the moving, coated web; and a collection container operatively secured with the nozzle assembly to the movable carriage, wherein the collection container and the nozzle assembly are capable of being simultaneously positioned by the carriage along the outside edge of the moving, coated web, and the fluid jet of the nozzle assembly is directed in a direction toward an opening of the collection container.

One or more of the foregoing aspects of the present invention is also accomplished, in part, by a method of cleaning an outside edge of a movable, coated web, the method comprising positioning an edge cleaner device with respect to an outside edge of a movable, coated web, wherein the edge cleaner device is positioned upstream from a roller for operatively engaging the moving, coated web; imparting a fluid jet from a nozzle assembly of the edge cleaner device toward an underside and an outside edge of the moving, coated web; and simultaneously positioning a scraper device along the outside edge of the moving, coated web, wherein the scraper device is operatively engaged with an upper surface of the moving web without contacting a surface of the roller.

One or more of the foregoing aspects of the present invention is also accomplished, in part, by a method of cleaning an outside edge of a movable, coated web, the method comprising positioning an edge cleaner device with respect to an outside edge of a movable, coated web, wherein the edge cleaner device is positioned upstream from a roller for operatively engaging the moving, coated web; imparting a fluid jet from a nozzle assembly of the edge cleaner device toward an underside and the outside edge of the moving, coated web; and simultaneously positioning a collection container operatively secured with the nozzle assembly, wherein the collection container and the nozzle assembly are simultaneously positioned along the outside edge of the moving, coated web, and the fluid jet of the nozzle assembly is directed in a direction toward an opening of the collection container.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings that are given by way of illustration only, and thus do not limit the present invention.

DETAILED DESCRIPTION OF THE PREFERRED EMBODIMENTS

Figure 1:
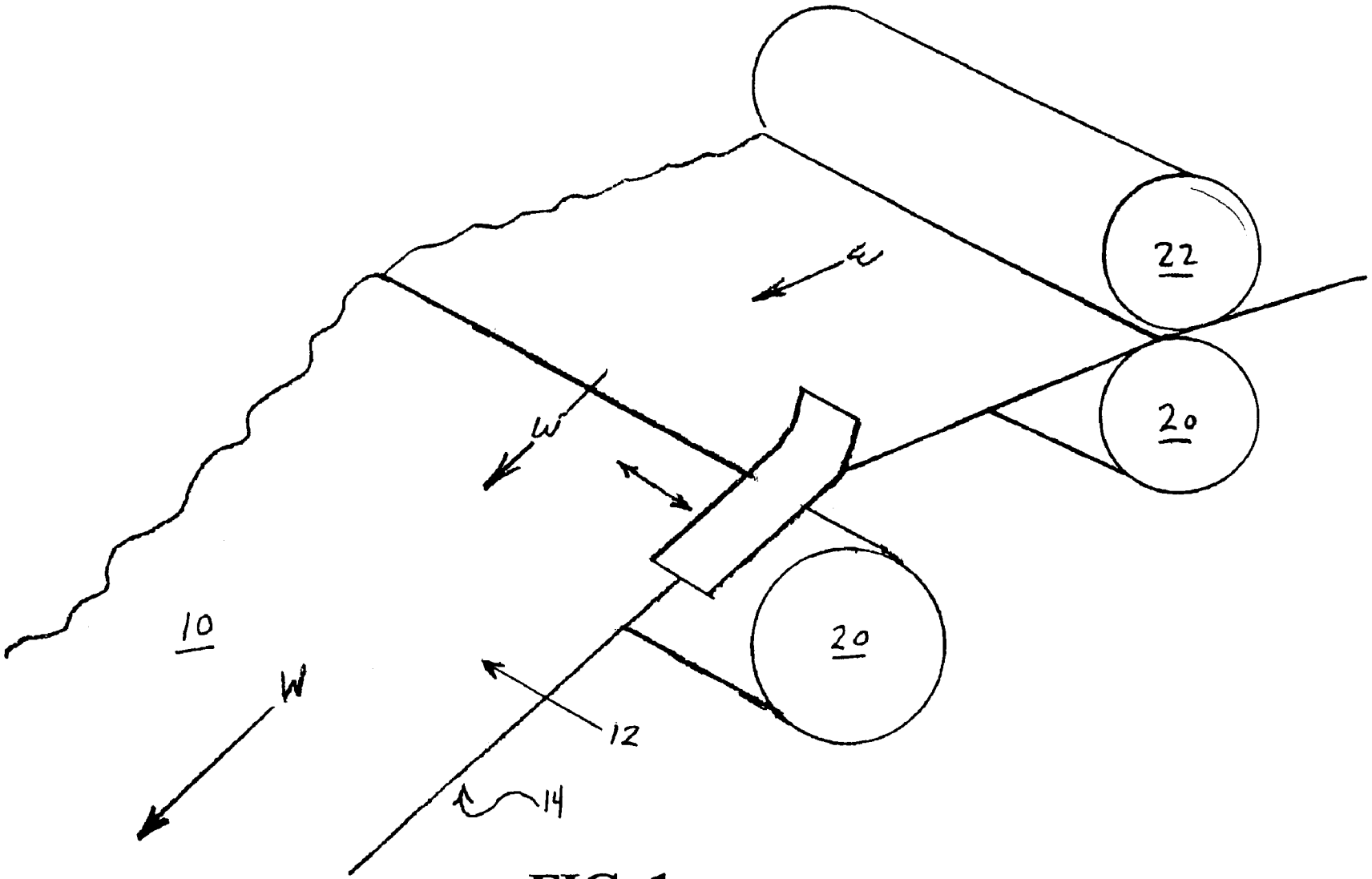
FIG. 1 is a side view of a coated web moving past a backing roller and an edge cleaner device of the present invention.
Figure 2:
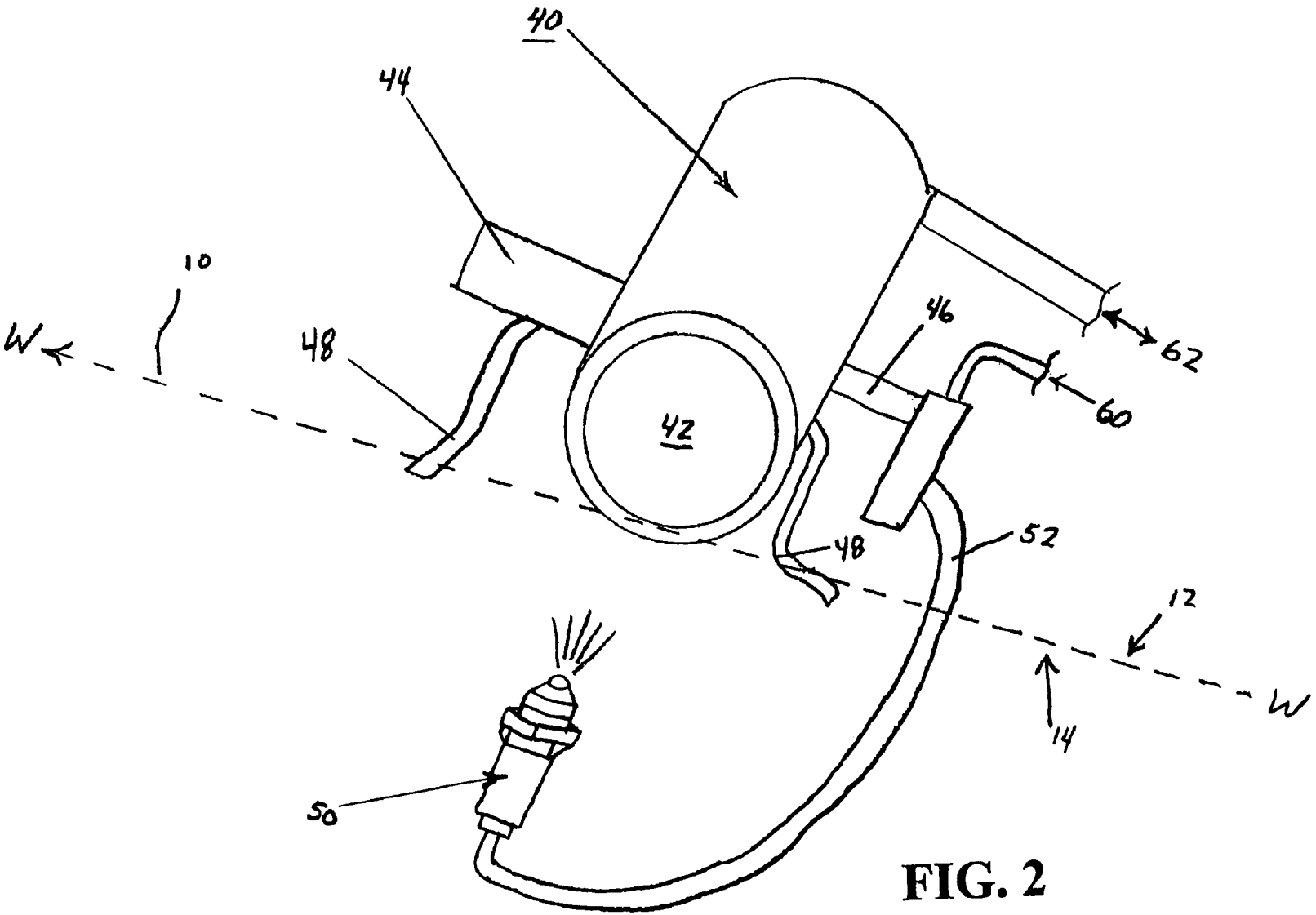
FIG. 2 is a perspective view of an edge cleaner device according to an embodiment of the present invention.
Figure 3:
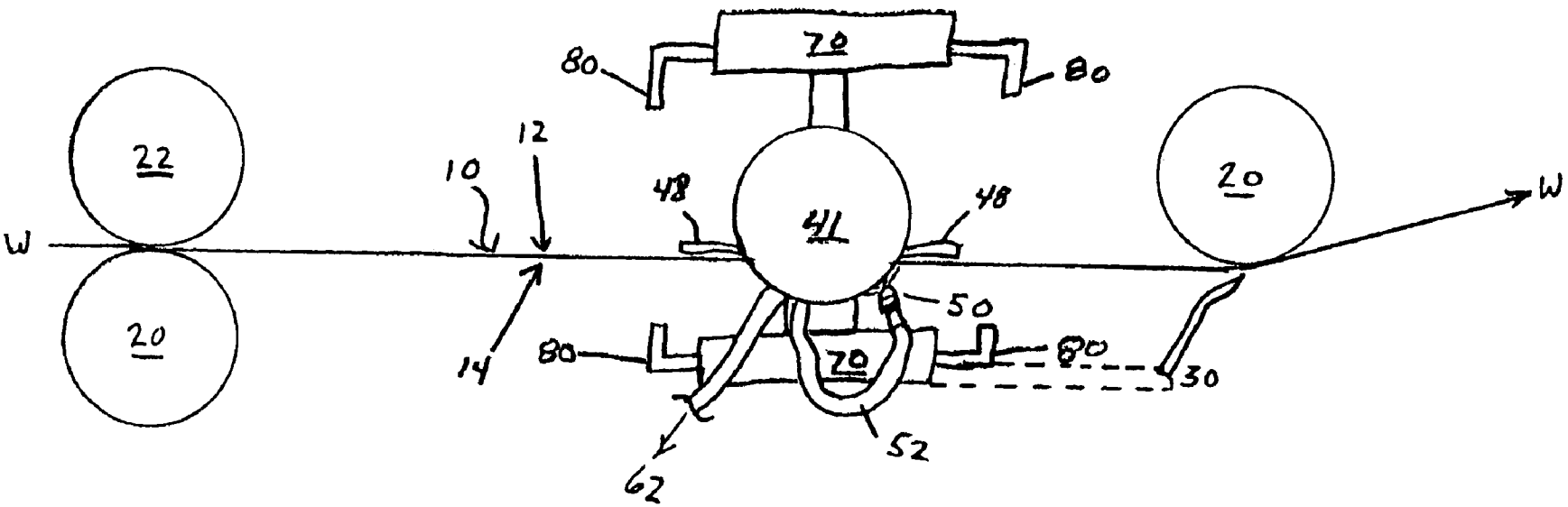
FIG. 3 is a schematic view of an edge cleaner device according to an embodiment of the present invention.
Figure 4:
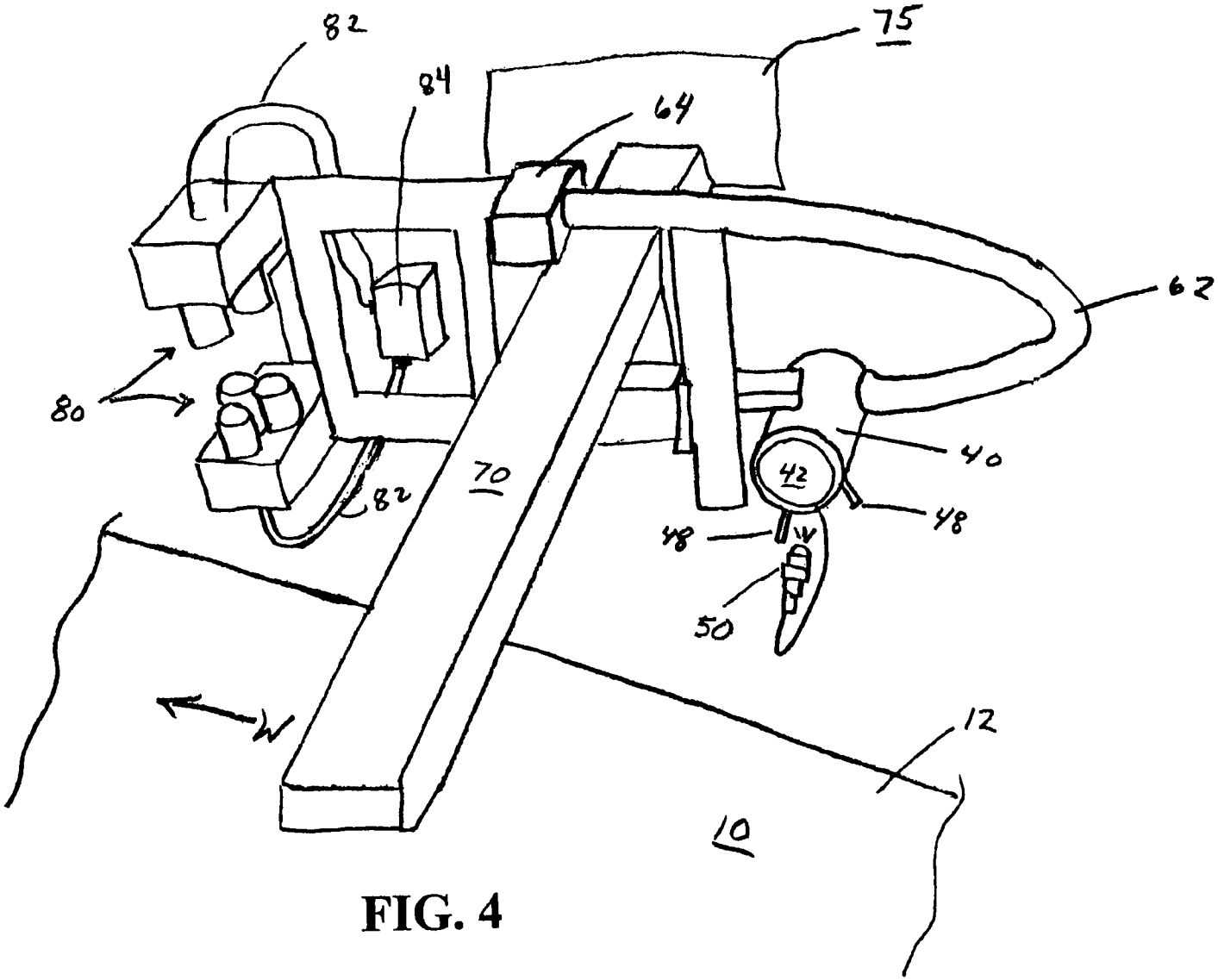
FIG. 4 is perspective view of an edge cleaner device according to an embodiment of the present invention.

The present invention will now be described in detail with reference to the accompanying drawings. The present inventors have analyzed the needs of the background art and identified several shortcomings associated with the systems of the background art. FIG. 1 is a side view of a coated web moving past a backing roller and an edge cleaner device of the present invention. FIG. 2 is a perspective view of an edge cleaner device according to an embodiment of the present invention. FIG. 3 is a schematic view of an edge cleaner device according to another embodiment of the present invention. FIG. 4 is perspective view of an edge cleaner device according to another embodiment of the present invention.

As seen in FIG. 1, a coating is applied to a moving web 10 having a first coated side 12 and a second, uncoated side 14 moving through a process along a first process direction W. The web 10 is moved between a coating roll 22 (as seen in FIG. 3 in a retracted position) pressed against a rubberized backing roll 20 in order to ensure an even distribution of the coating applied to the web 10. However, the present inventors have determined that some of the coating will appear to wrap around the moving web 10 from a first coated side 12 to an opposite, typically uncoated side 14 both before (upstream with respect to direction W) and at the backing roller 20.

A first edge cleaning device of the present invention can incorporate a thin scraper device 30, e.g., a blade is shown in FIG. 1, constructed of foil or other thin metal, or thin non-metallic substances exhibiting non-stick properties such as Teflon (tetrafluoroethylene). The scraper device 30 is arranged to be positioned generally in parallel to the moving direction W of the web 10. As seen in FIG. 1, a portion of the scraper device 30 is positioned in contact with the moving web 10 and with a portion of the rubberized backing roll 20. Accordingly, the scraper device 30 is designed to scrape away any excess coating attempting to carryover from the coated side 12 of the web to the surfaces of the backing roll 20 and/or the underside of the web, e.g., the uncoated side 14 of the web.

However, the present inventors have determined that abrasion marks form over time in the surface of the rubberized backing roll. In order to compensate for the effects of the scraper device 30, coating runs are often scheduled so that the widest webs are ran through the rollers 20, 22 first and the narrower webs are then gradually processed as the rubberized backing roll 20 is abraded or otherwise worn. After repeated coating runs, the rubberized backing 20 typically requires replacement resulting in costly machine down times and/or maintenance and repair.

Alternatively, the present inventors have determined that the scraper device 30 can be optimally positioned so that it only contacts the moving web, e.g., and does not significantly contact the surface of the backing roll 20. The inventors have determined that this approach is successful in minimizing carryover of excess coating to the surfaces of the backing roller 20 and/or the underside 14 of the moving web 10. The scraper device 30 rides only on the paper web 10 to the edge but does not overlap to touch the adjacent backing roller 20 surface (as shown in FIG. 1).

Accordingly, by not touching the backing roller 20 surface, the problem of marring of the roll is effectively eliminated. However, the present inventors have determined that additional features in combination with the optimized scraper device 30 and/or standing alone, when incorporated into a non-contact edge cleaning device will further optimize and/or offer alternative approaches to minimizing carryover of excess coating along the edge of the moving web. For example, the scraper device 30 preferably rides only on the paper web, e.g., riding on the underside or uncoated side 14 of the paper web 10 to the edge of web but not overlapping to touch an adjacent roller, e.g., such as backing roller 20.

Alternatively, the scraper device 30 is preferably applied to a slightly or moderately tensioned web without need for a backing roll, e.g., the use of a backing roller 20 may be optional. In a more preferred embodiment, the scraper blade is positioned at about a 90° angle θ to the underside or uncoated side 14 of the paper web as part of the moveable carriage 70 assembly, although a wide range of angles may be employed as discussed in greater detail hereinafter. The scraper blade or scraper device 30 can be integral to the carriage assembly or a separately supported and movable component. By riding on the uncoated underside of the web, any coating that wraps around the web is easily and conveniently removed by scraper device 30 and the water jet of nozzle assembly 50. The scraper device 30 is positioned in proximity to collecting container 40 and nozzle assembly 50. The fluid jet from nozzle assembly 50 is directed toward the underside edge of the moving web (and in the direction of container 40) so as to direct excess coating toward container 40. Therefore, any remaining coating or water wrapping around to uncoated side 14 is conveniently removed by scraper device 30.

Figure 6:
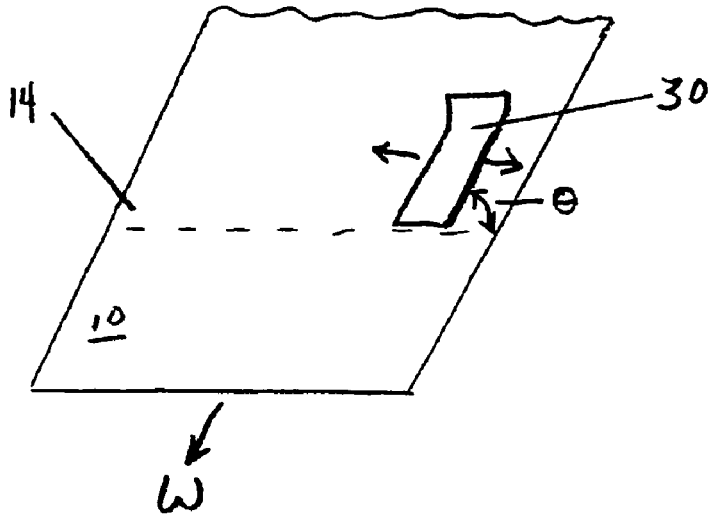
FIG. 6 is a schematic view of a scraper device being applied to an underside of a moving web.
Figure 7:
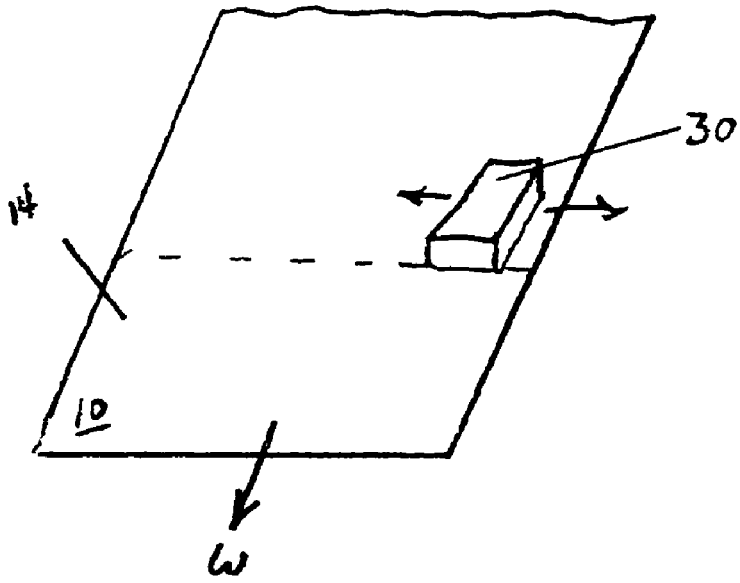
FIG. 7 is a schematic view of a scraper device being applied to an underside of a moving web.
Figure 8:
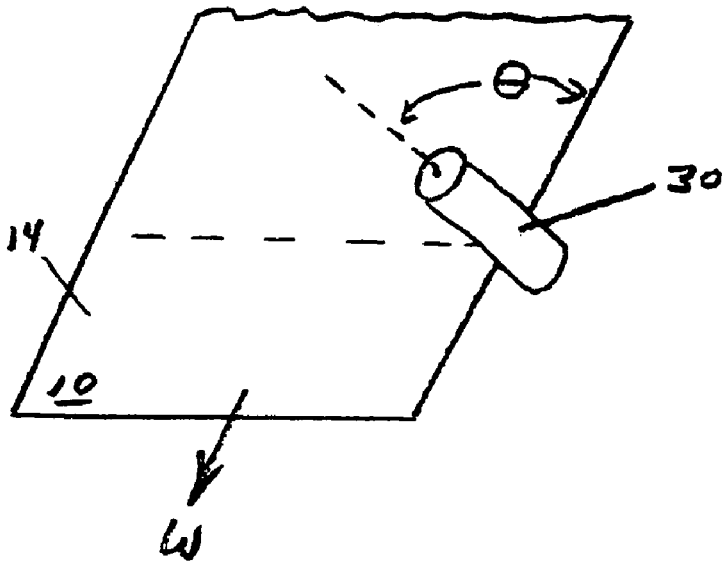
FIG. 8 is a schematic view of a scraper device being applied to an underside of a moving web.

FIG. 6 is a schematic view of a scraper blade device being applied to an underside of a moving web. FIG. 7 is a schematic view of a scraper device (blunt object) being applied to an underside of a moving web. FIG. 8 is a schematic view of a scraper device (roller) being applied to an underside of a moving web. The role of the scraper device 30 is to remove any excess fluid or coating remaining or wrapping around to the uncoated underside 14 of the web. It will be readily evident to the skilled artisan that scraper device 30 can take the form of a blade (FIG. 6), blunt object (FIG. 7) or even a similar width (to this blade) small roller (FIG. 8), such as a small metal or nylon wheel or roller, to which drag is applied to hinder rolling such that a dragging or scraping effect is achieved, or even a stationary roller separate from the movable carriage 70. Drag can also be effectively created by offsetting such a small roller at a slight angle θ to the direction of travel of the web creating a slight scraping effect. The scraper device 30 can also take the form of a forceful air jet or air knife, though a blade as shown in a preferred embodiment in the enclosed figures. Therefore, all such variations are viewed as a scraper device 30 for purposes of simplicity in description for the present invention.

Figure 5:
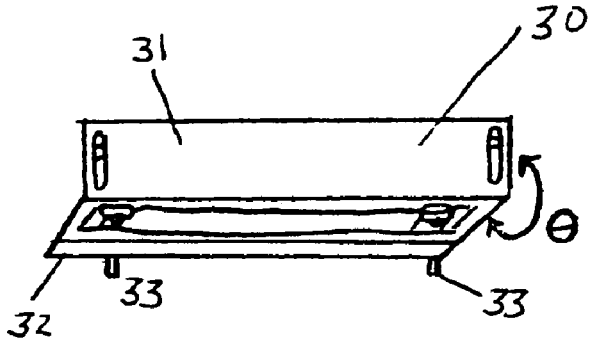
FIG. 5 is a perspective view of a scraper blade device according to an embodiment of the present invention.

FIG. 5 is a perspective view of a scraper blade device according to an embodiment of the present invention. As mentioned hereinabove, the term scraper device 30 and scraper device 30 have been used interchangeably. One of skill in the art will appreciate that in a preferred embodiment, the scraper device (blade) 30 may include a blade 32 having a working edge that is operatively secured into a clamping mechanism and holder 31. The holder 31 and the blade 32 can be positioned at a variety of angles θ with respect to each other to optimize the desired angle of attack with respect to the underside 14 of the moving web 10. Although a variety of acute and obtuse angles θ may be employed, a desired range of angle θ is between 75 and 95 degrees, and more particularly between 90 and 95 degrees. In addition, the blade 32 may be secured to the holder 31 via fasteners, e.g., such as the pair of thumb screws 33 shown in FIG. 5.

For example, as seen in FIG. 2 and FIG. 3, the present inventors have determined that an edge cleaner device can incorporate a fluid jet from a nozzle assembly 50 that is directed at the underside 14 of the coated web 10 in a direction toward the outside edge of the moving web 10. The fluid jet from the nozzle assembly 50 can be a jet of air, water or air/water mist that is directed in a position that will separate and/or carry away any excess coating migrating from the upper edge 12 of the coated web 10 toward the underside or uncoated side 14 of the coated web 10 away from the coated web 10. As seen in FIGS. 2 and 3, an optional receiving drain or collection container 40 is positioned with respect to an edge of the moving web 10 in a position that permits the container 40 to collect any excess coating separated and/or carried away with the fluid jet of the nozzle assembly 50.

The nozzle assembly 50 may incorporate a needle nose jet of water, air, or combination thereof directed toward the opening 42 of the container 40. U.S. Pat. No. 2,653,566 to Worden; U.S. Pat. No. 3,351,039 to Heisterkamp; U.S. Pat. No. 4,359,964 to Johnson; and U.S. Pat. No. 6,176,939 to Oechsle et al. describe the construction, materials and operation of several nozzle assemblies of the background art employing water, air and/or water/air mist fluid flows that may be incorporated into the unique edge cleaning device of the present application. Accordingly, the entirety of each of the above-identified applications is hereby incorporated by reference.

The collection drain or container 40 can be formed in a variety of shapes and positions that allow the container 40 to collect and/or carry away excess coating. For example, the container 40 can be a conical or cylindrically shaped receiving cup 40 or cone that includes a vacuum supplied by a vacuum hose 62, e.g., such as a reinforced, flexible hose. The receiving cone or container 40 can be supplied with vacuum, but this arrangement is optional depending upon the desired application. As seen in FIGS. 2 and 3, the container 40 is provided with an opening 42 at a front side of the container 40 for collecting excess coating and one or more optional guides 48 extending from the sides of the container 40 to engage the upper surface 12 of the moving web 10 and prevent the web from excessively deviating from the moving path W, e.g., curling in response to the fluid jet of the nozzle assembly 50 directed at the underside 14 of the web.

The nozzle assembly 50 is supplied via a supply hose 52, 60 or rigid tubing providing some structural support and positioning of the nozzle assembly 50 with respect to the web 10. The fluid of the nozzle assembly 50 is preferably a water jet positioned to disperse the coating material without need of applying a vacuum. The fluid jet can be a stream of water, preferably a needle stream or sharp stream of water under pressure. However, one of skill in the art will appreciate that various pressures and/or combinations of water/air and spray patterns may be useful for some coatings, e.g., depending upon the characteristics of the coating such as viscosity or rheology. However, a needle stream of water directed at the edge of the web 10 in the direction of the container 40 is utilized in a preferred embodiment.

As aforementioned, the scraper device 30 may be used in combination with the nozzle assembly 50 and/or the vacuum container 40. The scraper device 30 in combination with water jet 50 moves or disperses the bead of any excess coating into the receiving container 40. In addition, the edge cleaner device is preferably provided with a moveable carriage 70 or support structure that permits movement of the edge cleaning device sideways, e.g., movable toward and away from the edge of the web, and even vertically if desired. In a preferred embodiment, the carriage 70 includes a position controller 84 and a motor 75 or other device permitting movement and positioning of the carriage 70 of the edge cleaner device. Since the edge cleaning device is sideways movable toward and away the edge of the web 10, it can be quickly and accurately positioned relative to a wide range of sizes of coated webs 10. In addition to the guides 48 for controlling the positioning of the moving web 10 with respect to the edge cleaner device, the present invention may incorporate other self-positioning or position control features.

For example, as seen in FIGS. 3 and 4, a positioning device 80 for detecting the position of the coated web 10 with respect to the edge cleaning device is provided in a position that allows the web 10 to pass through opposite sides 80 of the positioning device 80. The positioning device 80 may include two or more electric eyes or sensors that are operatively coupled to the edge cleaning device. The sensors may be set so that a first beam is broken or interrupted by the web passing therebetween. A second set of sensors may be employed in an offset position that allows the beam passing therebetween to be uninterrupted when the edge cleaning device is engaged with the moving web 10.

One of skill in the art will appreciate that the edge cleaning device is shown positioned in a retracted position, e.g., away from the moving edge of the coated web 10 in FIG. 4. A logic circuit within the controller 84 of the positioning device 80 will maintain a proper positioning of the edge cleaning device, e.g., by moving the edge cleaning device along rails of the carriage 70, with respect to the web. The signals from the sensors of the positioning device 80 may be transferred via communication lines or cables 82 operatively connecting the controller 84 with the sensors of the positioning device 80. In a preferred embodiment, the nozzle assembly 50, receiving container 40, scraper device 30 (not shown in FIG. 4) and positioning device 80 are all mounted directly or indirectly to the movable carriage. Accordingly, the electronic eyes or sensors can be used to facilitate rapid and accurate positioning of the edge cleaning device and all its components with the outside edge of the moving web 14. Since the resulting combination of components, e.g., scraper device 30, nozzle assembly 50, etc., is quickly and accurately positioned along the edge of the moving web 10, the undesirable contact with the surfaces of the abradable, rubberized backing roll 20 of previous systems is effectively eliminated. Accordingly, coating processes of various webs may be scheduled in a variety of manners while effectively eliminating costly downtime to repair components, e.g., such as the replacement of the worn backing rollers 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An edge cleaning device for an outside edge of a moving, coated web, said device comprising:

a nozzle assembly imparting a fluid jet toward the outside edge of the moving, coated web; and a scraper device operatively secured with said nozzle assembly to a common carriage, wherein said nozzle assembly and said scraper device are simultaneously positioned by said carriage along the outside edge of the moving, coated web.

2. The edge cleaning device according to claim 1, further comprising a collection container, wherein said collection container is operatively positioned opposite to said fluid jet of said nozzle assembly for collecting excess coating directed by said fluid jet.

3. The edge cleaning device according to claim 2, wherein said collection container is provided with a supply of vacuum to assist in collecting the excess coating directed by said fluid jet.

4. The edge cleaning device according to claim 1, wherein said nozzle assembly imparts a fluid jet directed at an underside of said moving web, said fluid jet consisting of at least one of water and air.

5. The edge cleaning device according to claim 3, wherein said nozzle assembly imparts a fluid jet directed at an underside of said moving web, said fluid jet consisting of at least one of water and air.

6. The edge cleaning device according to claim 1, further comprising a positioning device for detecting a relative position of the edge cleaner device with respect to the moving web.

7. The edge cleaning device according to claim 6, wherein said positioning device includes at least one pair of optical sensors arranged in a mutual opposite position with respect to one another, wherein said optical sensors transmit an optical signal therebetween for indicating the relative position of the edge cleaner device with respect to the moving web.

8. The edge cleaning device according to claim 5, further comprising a positioning device for detecting a relative position of the edge cleaner device with respect to the moving web.

9. The edge cleaning device according to claim 8, wherein said positioning device includes at least one pair of optical sensors arranged in a mutual opposite position with respect to one another, wherein said optical sensors transmit an optical signal therebetween for indicating the relative position of the edge cleaner device with respect to the moving web.

10. The edge cleaning device according to claim 2, further comprising at least one guide post for aligning said moving web with respect to said fluid jet, said at least one guide post extending from a side of said collection device.

11. A system for cleaning an outside edge of a moving, coated web, said system comprising:

a moving, coated web;

a roller for operatively engaging said moving, coated web;

a movable carriage supporting an edge cleaning device;

a nozzle assembly imparting a fluid jet toward the outside edge of the moving, coated web; and a scraper device operatively secured with said nozzle assembly to the movable carriage, wherein said nozzle assembly and said scraper device are simultaneously positioned by said carriage along the outside edge of the moving, coated web.

12. The system according to claim 11, wherein said nozzle assembly imparts a fluid jet directed at the underside of said moving web, said fluid jet consisting of at least one of water and air.

13. The system according to claim 11, further comprising a positioning device for detecting a relative position of the edge cleaner device with respect to the moving web.

14. The system according to claim 13, wherein said positioning device includes at least one pair of optical sensors arranged in a mutual opposite position with respect to one another, wherein said optical sensors transmit an optical signal therebetween for indicating the relative position of the edge cleaner device with respect to the moving web.

15. The system according to claim 14, further comprising a collection container operatively secured with said nozzle assembly to the movable carriage, wherein said collection container and said nozzle assembly are simultaneously positioned by said carriage along the outside edge of the moving, coated web, and said fluid jet of said nozzle assembly is directed in a direction toward an opening of said collection container.

16. The system according to claim 11, wherein said scraper device is separately positionable from said movable carriage, and said scraper device is positioned along the outside edge of the moving, coated web.

17. The system according to claim 11, wherein said scraper device is positioned along the outside edge of the moving, coated web along either the underside or an upper side of the web.

18. The system according to claim 17, wherein said scraper device is positioned at the underside of the web.

* * * * *